US005551410A

United States Patent [19]

Messih et al.

[11] Patent Number: 5,551,410

[45] Date of Patent: Sep. 3, 1996

[54] ENGINE CONTROLLER WITH ADAPTIVE FUEL COMPENSATION

[75] Inventors: Isis A. Messih, Troy; Charles F. Aquino, Ann Arbor, both of Mich.

[73] Assignee: Ford Motor Company, Dearborn, Mich.

[21] Appl. No.: 506,716

[22] Filed: Jul. 26, 1995

[51] Int. Cl.[6] ..... F02D 41/14

[52] U.S. Cl. ..... 123/679

[58] Field of Search ..... 123/674, 675, 123/679, 681, 682, 688, 697

[56] References Cited

U.S. PATENT DOCUMENTS

| | | | |
|---|---|---|---|
| 4,235,204 | 4/1979 | Rice | 123/674 |
| 4,355,618 | 10/1982 | Muller et al. | 123/679 |
| 4,635,200 | 1/1987 | Egami et al. | 364/431.05 |
| 4,653,451 | 3/1987 | Kobayashi et al. | 123/679 |
| 5,040,513 | 8/1991 | Schnaibel et al. | 123/679 |
| 5,099,818 | 3/1992 | Takahashi et al. | 123/679 |
| 5,115,781 | 5/1992 | Kurita et al. | 123/679 |
| 5,243,952 | 9/1993 | Ikuta et al. | 123/682 |
| 5,335,643 | 8/1994 | Abate et al. | 123/679 |
| 5,347,974 | 9/1994 | Douta et al. | 123/682 |
| 5,353,768 | 10/1994 | Messih et al. | 123/491 |

*Primary Examiner*—Willis R. Wolfe

*Attorney, Agent, or Firm*—Allan J. Lippa; Roger L. May

[57] ABSTRACT

An Electronic Engine Controller (EEC) determines the actual dynamic response of an engine which uses a switching type Heated Exhaust Gas Oxygen Sensor (HEGO) by imposing a bias on the air/fuel (A/F) mixture when the engine is operating at steady state conditions and is combusting a stoichiometric A/F mixture. The A/F mixture is then abruptly altered and maintained for a predetermined period of time, and the time elapsed from the abrupt alteration to detection of the abrupt alteration by the HEGO sensor is measured and stored. Upon expiration of the predetermined period of time, the A/F mixture is abruptly altered to the biased A/F mixture and the time elapsed from the abrupt alteration to the biased value to the detection of the abrupt alteration is measured and stored. The bias value is then removed to return the A/F mixture to stoichiometry and the process is repeated for a plurality of bias values. The actual dynamic response of the engine is then determined as a function of the stored time durations. The actual dynamic response is compared to a predetermined response range and the fuel flow characteristics of the engine are altered if the actual dynamic response is outside of the predetermined response range.

7 Claims, 4 Drawing Sheets

ENGINE CONTROLLER WITH ADAPTIVE FUEL COMPENSATION

FIELD OF THE INVENTION

This invention relates to the field of electronic engine control and more particularly to adaptively altering fuel flow to compensate for long term changes in engine operating characteristics.

BACKGROUND OF THE INVENTION

Electronic engine controllers typically utilize an Exhaust Gas Oxygen sensor (EGO) to provide an indication of the actual air/fuel (A/F) mixture combusted by the engine. EGO sensors take a variety of forms, but most production vehicles utilize a switching type EGO sensor which provides a first voltage level to indicate that the concentration of oxygen in the exhaust gas is rich of stoichiometry, and a second voltage level to indicate that the concentration of oxygen in the exhaust gas is lean of stoichiometry.

As engine components age, the changing characteristics of the components causes the dynamic response of the engine to change. For instance, deposits which form on the intake valves cause subtle changes in the fuel flow. Switching type EGO sensors which provide only a qualitative indication of the A/F ratio combusted by the engine, cannot, by themselves, provide an indication of the subtle changes brought about by aging of engine components.

It is accordingly an object of the present invention to provide an engine controller which can determine from information generated by a switching type EGO sensor the dynamic response of an engine and compensate for the subtle changes in the dynamic response which may have been due to long term effects such as aging.

SUMMARY OF THE INVENTION

In accordance with the primary object of the invention, an electronic engine controller which controls the delivery of fuel to an intake of an engine includes a means for receiving an air/fuel signal from a switching type exhaust gas composition sensor which provides a first indication if air/fuel mixture combusted by the engine is rich of stoichiometry and a second indication if the air/fuel mixture is lean of stoichiometry. The engine controller determines, from a plurality of the first and second indications, the actual dynamic response of the engine to a predetermined change in the air/fuel mixture. The actual dynamic response is then compared to a predetermined dynamic response, and if the actual dynamic response is outside of a predetermined response range, the delivery of fuel to the intake is altered to bring the actual dynamic response within the predetermined response range.

An advantage of certain preferred embodiments is that the dynamic response of the engine may be accurately assessed and compensated for without the use of more expensive components such as a Universal Exhaust Gas Oxygen (UEGO) sensor which provides a quantitative indication of the concentration of oxygen in the exhaust gas.

These and other features and advantages of the present invention may be better understood by considering the following detailed description of a preferred embodiment of the invention. In the course of this description, reference will frequently be made to the attached drawings.

DETAILED DESCRIPTION

Figure 1:
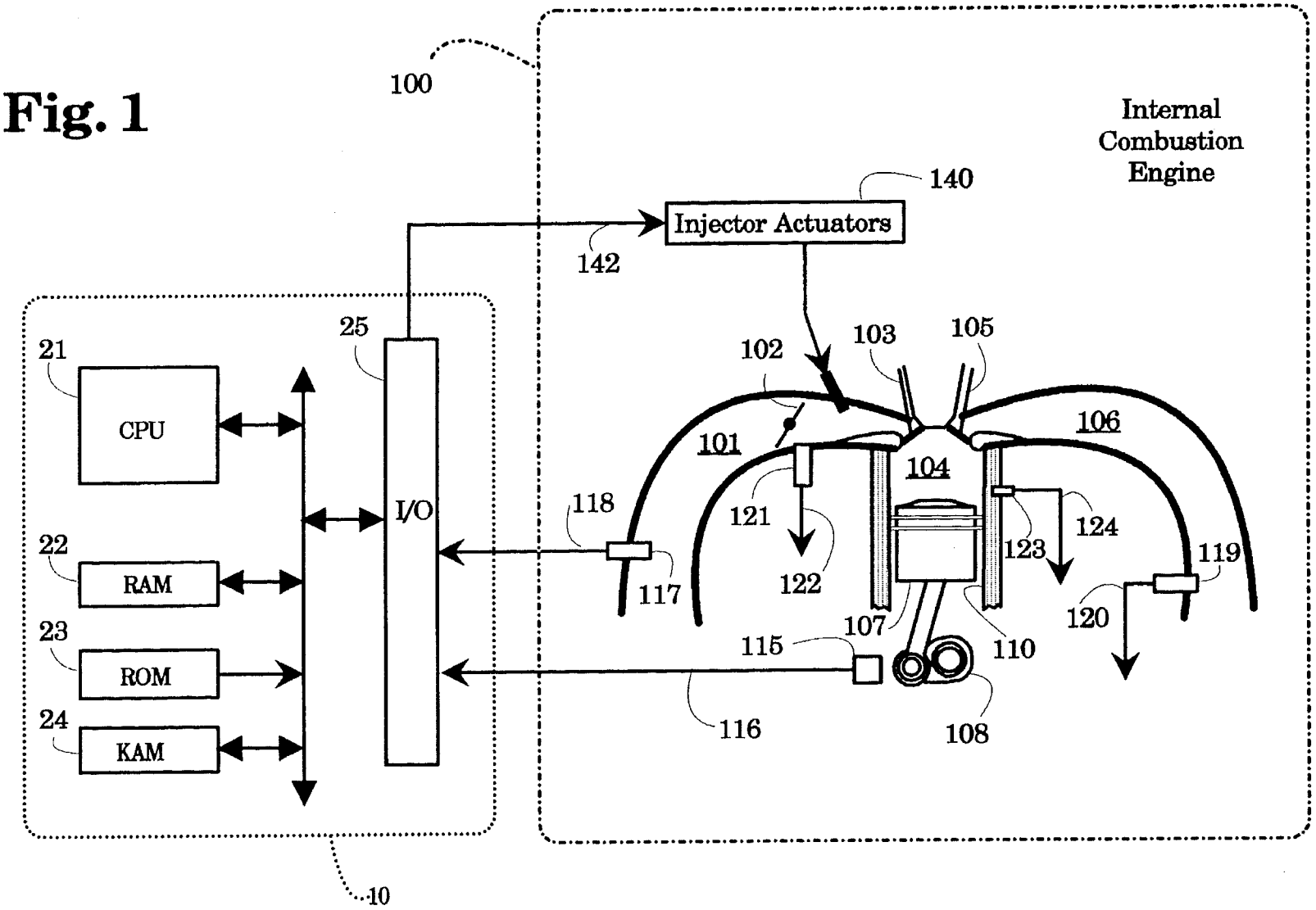
FIG. 1 of the drawings shows a schematic diagram of a preferred embodiment of portions of an internal combustion engine and an electronic engine controller which utilizes the principles of the invention.

FIG. 1 of the drawings shows an Electronic Engine Controller (EEC) 10 and an internal combustion engine 100. Engine 100 draws an aircharge through an intake manifold 101, past a throttle plate 102, an intake valve 103 and into combustion chamber 104. An air/fuel mixture which consists of the aircharge and fuel, is ignited in combustion chamber 104, and exhaust gas produced from combustion of the air/fuel mixture is transported past exhaust valve 105 through exhaust manifold 106. A piston 107 is coupled to a crankshaft 108, and moves in a reciprocating fashion within a cylinder defined by cylinder walls 110.

A crankshaft position sensor 115 detects the rotation of crankshaft 108 and transmits a crankshaft position signal 116 to EEC 10. Crankshaft position signal 116 preferably takes the form of a series of pulses, each pulse being caused by the rotation of a predetermined point on the crankshaft past sensor 115. The frequency of pulses on the crankshaft position signal 116 are thus indicative of the rotational speed of the engine crankshaft. A Mass AirFlow (MAF) sensor 117 detects the mass flow rate of air into intake manifold 101 and transmits a representative air meter signal 118 to EEC 10. MAF sensor 117 preferably takes the form of a hot wire air meter. A Heated Exhaust Gas Oxygen (HEGO) sensor 119 detects the concentration of oxygen in exhaust gas produced by the engine and transmits an exhaust gas composition signal 120 to EEC 10 which is indicative of the composition of the exhaust gas. HEGO sensor 119 is a switching type of sensor which generates a voltage of approximately one volt to the concentration of oxygen in the exhaust gas is rich of stoichiometry and a voltage of approximately zero volts is the concentration of oxygen in the exhaust gas is lean of stoichiometry. A throttle position sensor 121 detects the angular position of throttle plate 102 and transmits a representative signal 122 to EEC 10. Throttle position sensor 121 preferably takes the form of a rotary potentiometer. An engine coolant temperature sensor 123 detects the temperature of engine coolant circulating within the engine and transmits an engine coolant temperature signal 124 to EEC 10. Engine coolant temperature sensor 123 preferably takes the form of a thermocouple.

Injector actuators 140 operate in response to fuel injector signal 142 to deliver an amount of fuel determined by fuel injector signal 142 to combustion chambers 104 of the engine. EEC 10 includes a central processing unit (CPU) 21 for executing stored control programs, a random-access memory (RAM) 22 for temporary data storage, a read-only memory (ROM) 23 for storing the control programs, a keep-alive-memory (KAM) 24 for storing learned values, a conventional data bus, and I/O ports 25 for transmitting and receiving signals to and from the engine 100 and other systems in the vehicle.

Figure 2:
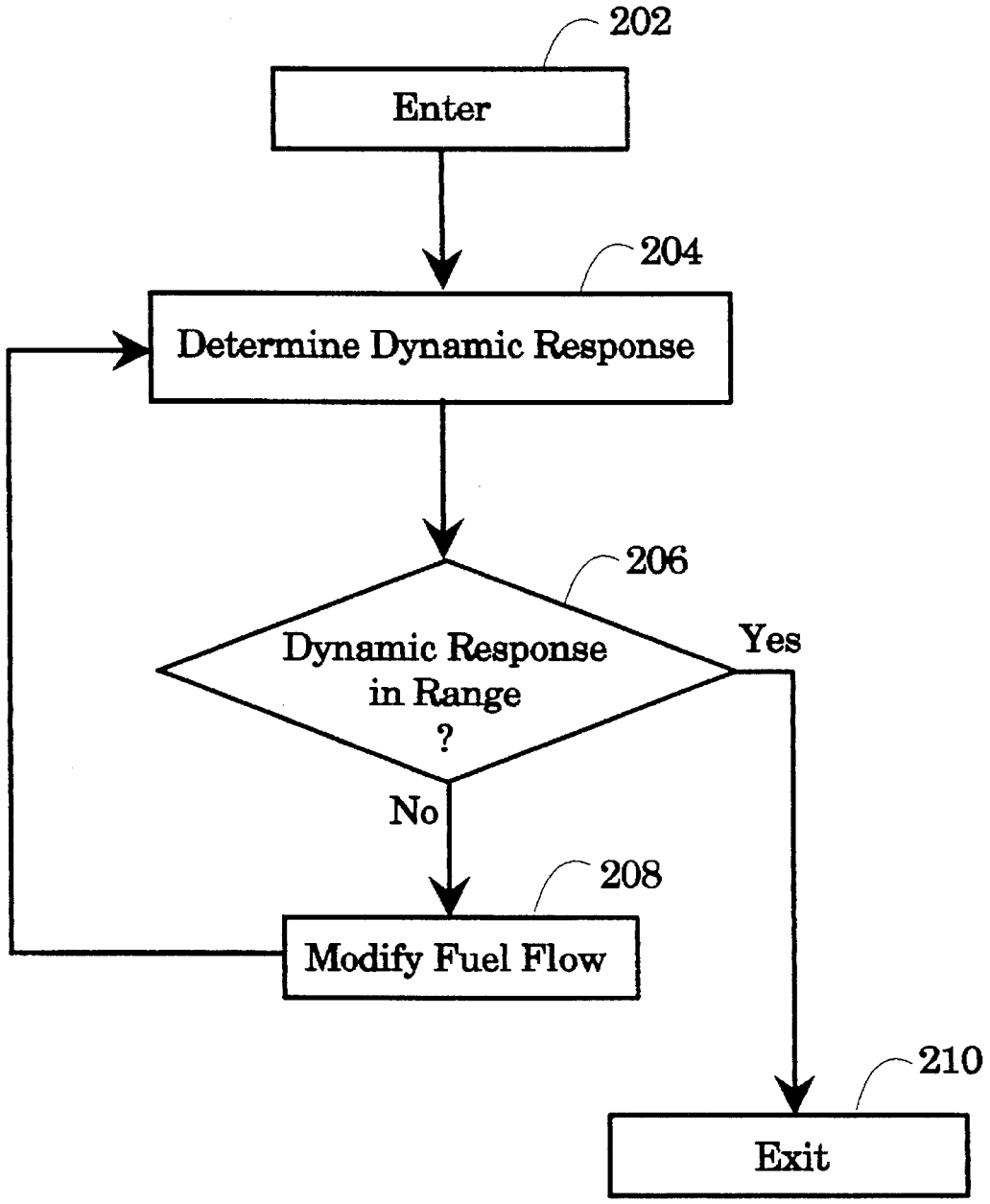
FIGS. 2 and 3 are flowcharts showing the operation of preferred embodiments.
Figure 3:
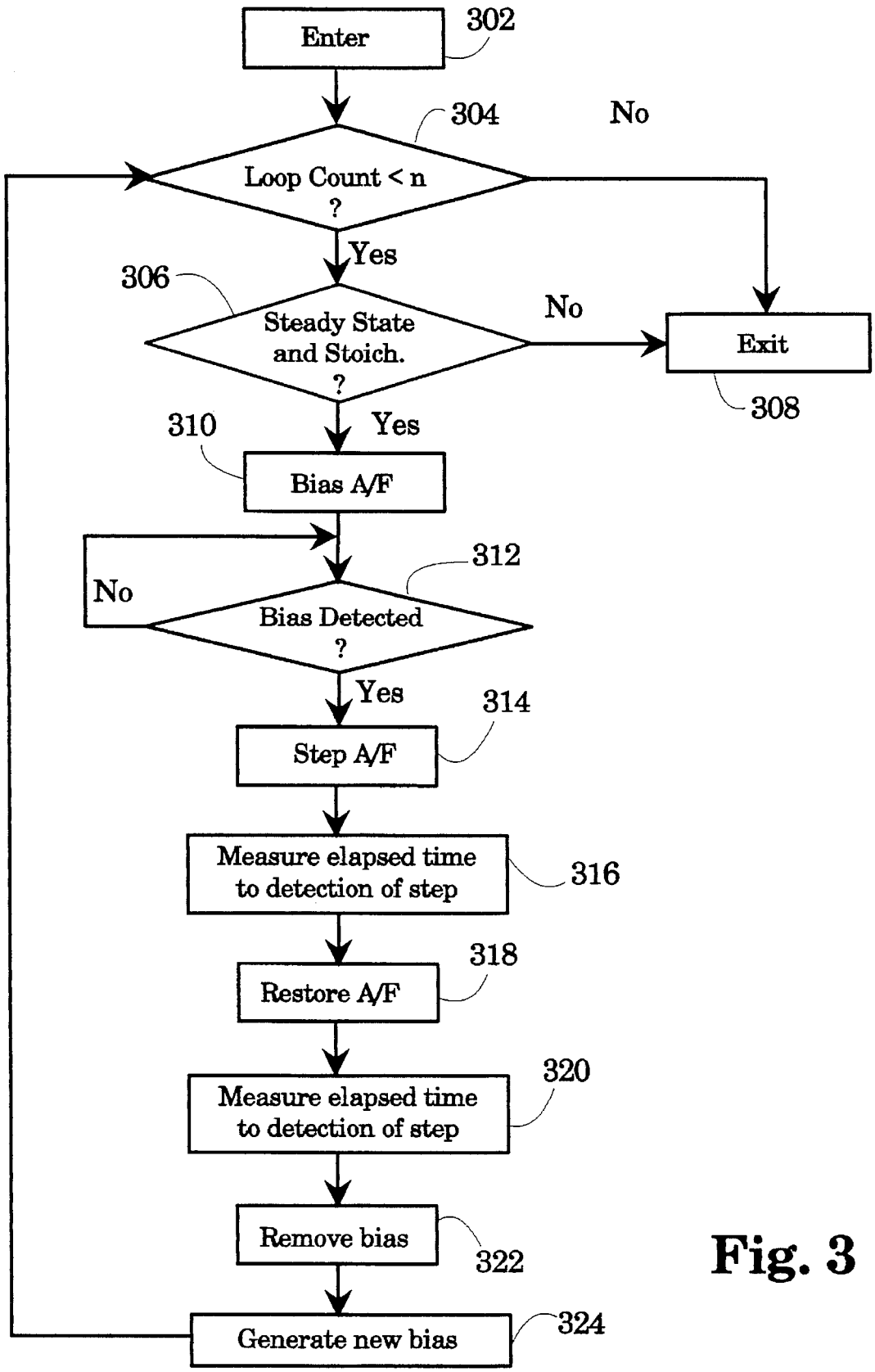

A preferred embodiment advantageously generates quantitative information of the dynamic response of the engine from the binary type of information provided by the HEGO sensor 119 and then alters the fuel flow to the engine if the dynamic response is outside of a predetermined range. FIG. 2 of the drawings shows the steps of a detection and compensation routine executed by a preferred embodiment to detect and alter the dynamic response of the engine. FIG. 3 of the drawings shows in greater detail the steps performed to detect the dynamic response of the engine. The routines of FIGS. 2 and 3 are preferably implemented as programs stored in ROM 23 and executed periodically. The frequency selected for execution of the routines of FIGS. 2 and 3 depends in large part on the frequency with which changes in engine operating characteristics are desired to be made. Less frequent changes to engine dynamic response take into account long term changes to the engine such as build-up of valve deposits and aging of components. However, more frequent changes to the engine dynamic response may be desired to compensate for the varying properties of fuel, such as evaporation characteristics, which may occur as new fuel is added to the vehicle's fuel tank.

In FIG. 2, at 204 the actual dynamic response of the engine is determined, and at 206, the actual dynamic response is compared to a predetermined dynamic response. If the actual dynamic response is within a predetermined range, then no compensation is performed and the routine is exited at step 210. Otherwise, if the actual dynamic response is outside of the predetermined range, the fuel flow delivery characteristics are altered at step 208 to bring the actual dynamic response within the predetermined range. U.S. Pat. No. 5,353,768 entitled Fuel Control System with Compensation for Intake Valve and Engine Coolant Temperature Warm-Up Rates which issued on Oct. 11, 1994 and which is assigned to the assignee of the present application, and which is hereby incorporated by reference explains the generation of a transient fuel control variable $TFC_{13}FUEL$ which indicates the fuel mass per injection from transient fuel compensation. The modification of fuel flow delivery characteristics at step 208 is preferably performed by repeated modification of the variable $TFC_{13}FUEL$. The routine is then repeated until the actual dynamic response is determined to be within the predetermined range. The predetermined range is preferably stored in ROM 23, and thus may advantageously be calibrated to reduce or increase the frequency with which changes to the dynamic response of the engine are made.

FIG. 3 of the drawings shows in greater detail, the steps executed at step 204 to determine the dynamic response of the engine. The routine is entered at step 302 and at step 304 a loop counter is checked to determined if the loop consisting of steps 304, 306, 310, 312, 314, 316, 318, 320, 322 and 324 has been executed a predetermined number of times, designated by variable "n". If so, then the routine is exited at step 308. Otherwise, at step 306, engine operating conditions are checked to determine if the engine is operating in a steady state condition and if the A/F ratio combusted by the engine is at stoichiometry. These determinations are preferably performed by detecting the position of throttle plate 102 to determine if the throttle plate is stationary or is moving. If the throttle plate 102 has not moved for a predetermined period of time, then the engine is determined to be operating in a steady state condition. Alternatively, the engine could be determined to be in a steady state condition if at step 306, the engine is operating in an idle mode. A plurality of engine speed and load points may be preselected to allow the dynamic response to be determined at a variety of engine operating points.

If the engine is not operating at the conditions specified at step 306, then the routine of FIGS. 2 and 3 is exited at step 308. Otherwise, at step 310, a bias value is generated to bias the fuel flow into the intake manifold by a first predetermined amount. The bias may be either an increased or decreased amount of fuel, causing an A/F mixture which is either rich or lean of stoichiometry. At step 312, the output of the HEGO sensor is checked to determine if the A/F mixture caused by the bias introduced at step 310 has been combusted. The routine of FIG. 3 is preferably performed as part of a background routine. Consequently, at step 312, if the bias in the A/F mixture has not been detected, then the EEC continues to perform other functions and performs the test at step 312 at some later point in time.

Once the bias is detected, at step 314, the fuel flow is abruptly altered (either increased or decreased) to cause an abrupt change or step in the A/F mixture combusted. The altered fuel flow is then maintained and step 316, the time duration from the abrupt alteration at step 314 to detection of the abrupt alteration by the HEGO sensor is measured and stored. At step 318, the fuel flow is again abruptly altered to restore the fuel flow to the rate existing before the abrupt alteration, i.e. to the biased fuel flow, and at step 320, the time duration from the abrupt alteration to the biased fuel flow is measured and stored. At step 322, the bias in the fuel flow is removed to restore the A/F mixture to a stoichiometric ratio. At step 324, a new, increased bias value is generated for use upon a subsequent execution of the loop starting at step 304. At step 304, loop counter "n" is compared to a predetermined loop counter, and if the number of loops specified by loop counter has not yet been performed then the loop starting at step 304 is repeated with the biased fuel flow determined at step 324.

Figure 4A:
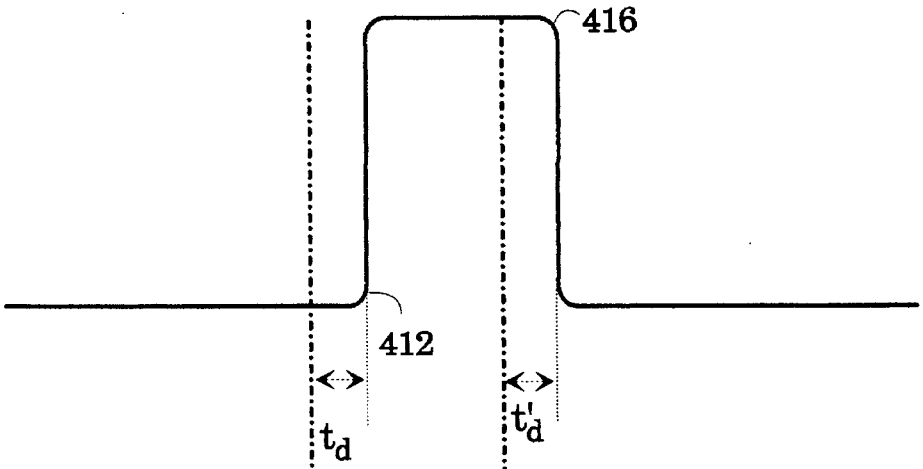
FIGS. 4(*a*), 4(*b*) and 4(*c*) illustrate graphically the operation of a preferred embodiment.
Figure 4B:
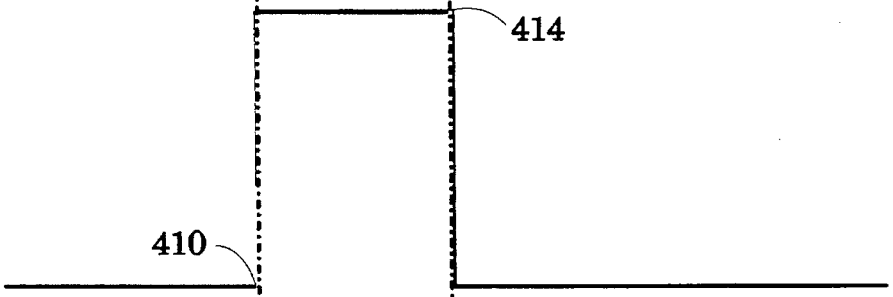
Figure 4C:
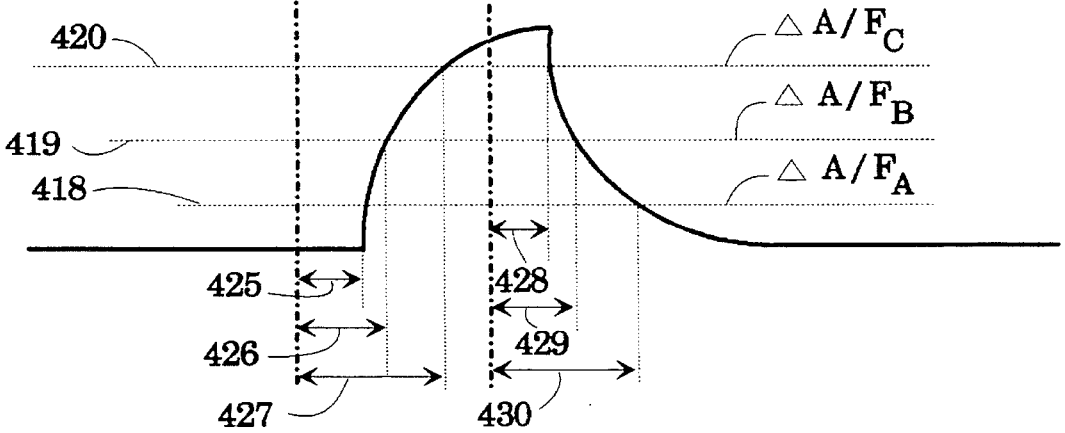

Once the elapsed time required for the HEGO sensor to detect the abrupt alteration, from the biased fuel flow to the altered fuel flow, and then from the altered fuel flow to the biased fuel flow, for a plurality of biased fuel flows, then a quantitative response of the engine to the dynamics presented by the abrupt fuel flow is calculated. FIGS. 4(*a–c*) of the drawings illustrate in graphical form the functions performed in FIG. 3.

In FIGS. 4(*a*), 4(*b*) and 4(*c*), the horizontal axis indicates time, and the vertical axis indicates A/F ratio. FIG. 4(*a*) shows the output of a linear type oxygen sensor such as a Universal Exhaust Gas Oxygen Sensor (UEGO) to a properly compensated engine. FIG. 4(*b*) shows the metered A/F mixture in combustion chambers of the engine. As seen in FIG. 4(*b*), an abrupt reduction in the fuel flow occurs at point 410 causing a step in the A/F ratio from the biased ratio to a lean A/F ratio. The abrupt reduction in the fuel flow causes the oxygen sensor in the properly compensated system of FIG. 4(*a*) to indicate the abrupt alteration at point 412, after the passage of a time duration indicated by the variable $t_d$. At point 414, the A/F ratio is abruptly altered to the biased ratio and at point 416 the abrupt alteration is detected by the oxygen sensor after the passage of time duration $t'_d$. Time durations $t_d$ and $t'_d$ are indicative of the delay from the change in an A/F mixture to detection of the combusted A/F mixture by the oxygen sensor.

FIG. 4(*c*) shows the dynamic response of an inadequately compensated engine to the A/F mixture imposed in FIG. 4(*b*). In FIG. 4(*c*), the effects of aging, such as the formation of deposits on the intake valves of the engine change the dynamic response of the engine. Rather than responding immediately to the change in fuel flow at point 410, the engine of FIG. 4(*c*), responds in the non-linear manner shown. The steps shown in FIG. 3 determine the dynamic response such as shown in FIG. 4(*c*) in order to compensate the fuel flow of the engine to achieve the dynamic response shown in FIG. 4(*a*).

As previously explained, a preferred embodiment employs a switching type oxygen sensor which provides only an indication of whether the A/F mixture combusted by the engine is rich or lean of stoichiometry. The biased fuel flows which result from the bias introduced in FIG. 3 are seen at dotted lines 418, 419 and 420. Once a bias is introduced, the step in fuel flow shown in FIG. 4(*b*) is introduced and the time duration required for the HEGO sensor to detect the abrupt change in the A/F mixture is detected. In FIG. 4(*c*), the time duration corresponding to biased fuel flow $\Delta A/F_A$ is seen at 425 and is the value $(t_d+\Delta t_1)$ where $t_d$ is the normal time delay required for the HEGO sensor to detect a change in the A/F mixture from rich to lean and $\Delta t_1$ is the additional time required, due to aging and other effects, for the HEGO sensor to detect the step change in A/F mixture caused by the step change in fuel flow in FIG. 4(*b*). As seen in FIG. 4(*c*), bias amounts $\Delta A/F_B$ and $\Delta A/F_C$ each cause different time delays 426 and 427 which, respectively, take the following forms: $(t_d+\Delta t_2)$ and $(t_d+\Delta t_3)$, and which as shown at step 316 are each measured and stored. The time delays once the A/F mixture is restored to the bias value each differ according to the bias value. These time delays are seen at 428, 429 and 430 and are respectively designated as: $(t'_d+\Delta t'_1)$, $(t'_d+\Delta t'_2)$ and $(t'_d+\Delta t_3)$. As shown at step 320, each of these values is also measured and stored. Once the time durations for a number of bias values is determined, a response of the type shown in FIG. 4(*c*) may be reconstructed from the plurality of measure time durations by known interpolation techniques. Once the actual dynamic response is reconstructed, it is compared, as seen at step 206 in FIG. 2, to a predetermined dynamic response, which preferably takes a form as shown in FIG. 4(*a*). The comparison between the predetermined and actual dynamic responses is preferably performed by comparing the actual response to the predetermined response at a plurality of discrete points in time to obtain an accurate determination of the differences between the actual and predetermined responses. If the actual dynamic response is outside of a predetermined range, then at 208, the fuel flow characteristics of the engine are repeatedly modified at step 208 as explained above. This process is repeated until the actual dynamic response is within the predetermined range.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. An electronic engine controller for controlling the delivery of fuel to an intake of an engine comprising:

means for receiving an air/fuel signal from a switching type exhaust gas composition sensor which provides a first indication if air/fuel mixture combusted by said engine is rich of stoichiometry and a second indication if said air/fuel mixture is lean of stoichiometry;

means for determining, from a plurality of said first and second indications, the actual dynamic response of said engine to a predetermined change in the air/fuel mixture;

means for comparing said actual dynamic response to a predetermined dynamic response; and means, responsive to said actual dynamic response being outside of a predetermined response range, for altering the delivery of fuel to said intake to bring said actual dynamic response within said predetermined response range.

2. The electronic engine controller as set forth in claim 1 wherein the means for determining the actual dynamic response of said engine to a predetermined change in the air/fuel mixture determines said actual dynamic response when said engine is operating at a predetermined steady state condition and the composition of said air/fuel mixture is substantially at stoichiometry.

3. The electronic engine controller as set forth in claim 2 wherein the means for determining the actual dynamic response of said engine to a predetermined change in the air/fuel mixture comprises:

first means, responsive to an indication of a stoichiometric air/fuel ratio, for altering a fuel injection value, indicative of an amount of fuel injected into said intake, by a first bias value;

second means, responsive to an indication by said exhaust gas composition sensor of detection of exhaust gas corresponding to said altered fuel injection value, for abruptly altering said fuel injection value by a first step value for a first predetermined period of time;

third means for generating one of said plurality of response time values by measuring an amount of time elapsed from said abrupt alteration of said fuel injection value by said step value, to an indication by said exhaust gas composition sensor of detection of exhaust gas corresponding to said abruptly altered fuel injection value;

fourth means, responsive to expiration of said first predetermined period of time, for altering said fuel injection value by said first bias value to achieve a substantially stoichiometric air/fuel ratio;

wherein, said means for determining the actual dynamic response of said engine determines aid actual dynamic response as a function of said plurality of response time values.

4. The electronic engine controller as set forth in claim 3 wherein the exhaust gas composition sensor is a heated exhaust gas oxygen sensor.

5. A method of controlling the delivery of fuel to an intake port of an engine, comprising the steps of:

(i) receiving a rich indication when exhaust gas generated by said engine indicates a rich air/fuel ratio combusted by said engine and receiving a lean indication when exhaust gas generated by said engine indicates a lean air/fuel ratio combusted by said engine;

(ii) altering, in response to an indication of a stoichiometric air/fuel ratio, a fuel injection value, indicative of an amount of fuel injected into said intake, by a bias value;

(iii) abruptly altering, in response to an indication by said exhaust gas sensor of detection of exhaust gas corresponding to said altered fuel injection value, said fuel injection value by a first step value for a first predetermined period of time;

(iv) generating a response time value by measuring an amount of time elapsed from said abrupt alteration of said fuel injection value by said step value, to an indication by said exhaust gas sensor of detection of exhaust gas corresponding to said abruptly altered fuel injection value;

(v) responding to expiration of said first predetermined period of time by altering said fuel injection value by said first bias value to achieve a substantially stoichiometric air/fuel ratio;

(vi) repeating said steps (ii) through (v) a predetermined number of times for a predetermined number of different bias values to generate a plurality of response time values;

(vii) generating, as a function of said plurality of response time values, an indication of the actual dynamic response of said engine;

(viii) comparing said actual dynamic response to a predetermined dynamic response; and (ix) if said actual dynamic response differs from said predetermined dynamic response by more than a predetermined amount, then incrementally altering the fuel flow rate to said intake port.

6. The method as set forth in claim 5 comprising the additional step of repeating steps (i) through (ix) a plurality of times until said actual dynamic response differs from said predetermined dynamic response by less than said predetermined amount.

7. An electronic engine controller for controlling the amount of fuel delivered to an intake of an engine comprising:

a switching exhaust gas sensor generating a rich indication when exhaust gas generated by said engine indicates a rich air/fuel ratio combusted by said engine and generating a lean indication when exhaust gas generated by said engine indicates a lean air/fuel ratio combusted by said engine;

means for generating a plurality of response time values comprising, first means, responsive to an indication of a stoichiometric air/fuel ratio, for altering a fuel injection value, indicative of an amount of fuel injected into said intake, by a first bias value;

second means, responsive to an indication by said exhaust gas sensor of detection of exhaust gas corresponding to said altered fuel injection value, for abruptly altering said fuel injection value by a first step value for a first predetermined period of time;

third means for generating one of said plurality of response time values by measuring an amount of time elapsed from said abrupt alteration of said fuel injection value by said step value, to an indication by said exhaust gas sensor of detection of exhaust gas corresponding to said abruptly altered fuel injection value;

fourth means, responsive to expiration of said first predetermined period of time, for altering said fuel injection value by said first bias value to achieve a substantially stoichiometric air/fuel ratio;

means, responsive to said plurality of response time values, for generating an indication of the dynamic response of said engine; and means, responsive to said indication of said dynamic response, for incrementally altering the fuel flow rate to said intake.

* * * * *